US006727869B1

(12) United States Patent
Kosaka

(10) Patent No.: US 6,727,869 B1
(45) Date of Patent: Apr. 27, 2004

(54) DISPLAY PANEL AND ITS DRIVING METHOD

(75) Inventor: Tadayoshi Kosaka, Kobe (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/243,682

(22) Filed: Feb. 3, 1999

(30) Foreign Application Priority Data

Feb. 23, 1998 (JP) ..... 10-039915

(51) Int. Cl.[7] ..... G09G 3/28
(52) U.S. Cl. ..... 345/60; 345/67
(58) Field of Search ..... 345/60, 66, 67, 345/68; 315/169.4; 313/581, 484

(56) References Cited

U.S. PATENT DOCUMENTS

| | | | | |
|---|---|---|---|---|
| 4,320,418 | A | | 3/1982 | Pavliscak |
| 4,554,537 | A | * | 11/1985 | Dick |
| 5,066,890 | A | * | 11/1991 | Salavin et al. |
| 5,086,257 | A | * | 2/1992 | Gay et al. |
| RE33,882 | E | * | 4/1992 | Morozumi |
| 5,182,489 | A | | 1/1993 | Sano |
| 5,825,128 | A | | 10/1998 | Betsui et al. |

FOREIGN PATENT DOCUMENTS

| | | |
|---|---|---|
| EP | 0 266 462 | 5/1988 |
| EP | 0 800 157 | 10/1997 |
| GB | 2 061 612 | 5/1981 |
| JP | 8-179726 | 7/1996 |
| JP | 8-306318 | 11/1996 |

OTHER PUBLICATIONS

Kehoe, J.L.: "Competitively Priced AC Plasma Displays", Wescon Technical Papers, vol. 33,, Nov. 1, 1989, pp. 757–759.

* cited by examiner

*Primary Examiner*—Regina Liang
(74) *Attorney, Agent, or Firm*—Staas & Halsey LLP

(57) ABSTRACT

A single data electrodes orthogonal to scan electrodes is arranged so as to be involved to adjacent two rows, where either one side of the data electrode can be addressed by the use of two scan electrodes for a single line, so that the quantity of the data electrodes be reduced to a half resulting in a reduction of reactive power required to charge the capacitance between the adjacent data electrodes.

20 Claims, 14 Drawing Sheets

DISPLAY PANEL AND ITS DRIVING METHOD

BACKGROUND OF THE INVENTION

1. Field of the Invention

This invention relates to a matrix type display panel, such as lasma display panel, i.e. PDP, plasma addressed liquid crystal display, i.e. PALC, liquid crystal display, i.e. LCD, and their driving methods.

Display panels have been getting popular as a display means to replace CRTs, cathode ray tubes. PDPs in particular have been employed to public displays such as information board at rail road stations and air port terminals due to the advantageous features in the wide view angles and suitability to the wide display screen. Moreover, PDPs have become widely accepted in home use, such as television receivers and computer monitors, upon the practical success of the color screen.

2. Description of the Related Arts

In the display panels of matrix display type, a line sequential addressing operation, that is a setting operation of the contents to be displayed, was performed by the use of scan electrodes to designate cells, that is display elements, on each line and data electrodes to designate cells on each row.

A single scan electrode was arranged for each line; and a single data electrode was arranged for each row orthogonal to the lines in the prior art simple matrix type display panel. That is, in a screen having m rows and n lines as shown in FIG. 14, m data electrodes D1, D2 . . . Dm and the n scan electrodes S1, S2 . . . Sn were provided. The arrangement pitch of scan electrodes S1, S2 . . . Sn was equal to the cell pitch along the row direction; and the arrangement pitch of data electrodes D1, D2 . . . Dm was equal to the cell pitch along the line direction. In PDPs of three-electrode surface discharge type structure now commercially available as a color display device, two electrodes are arranged for each line;

however, this structure to define the individual cells can be considered as a simple matrix structure similar to that shown in FIG. 14 because only one of the two electrodes is used for selecting the line.

In the prior art structures, there have been problems in that static capacitance between the electrodes becomes large.

Particularly in the color display panel including the cells of primary colors, R, G & B, aligning along the line direction, the influence of static capacitance between the data electrodes were serious because the row pitch is approximately one third of the line pitch. The cell size reduction to attempt the high resolution display causes an increase in the capacitance resulting in an increase in reactive power consumed in charging the capacitance. Waveforms of the driving pulses become less steep resulting in a considerable delay of the display response.

SUMMARY OF THE INVENTION

It is a general object of the invention to provide display panels and driving methods in which reactive power in the driving circuit is reduced by reducing electrostatic capacitance between the data electrodes.

In the present invention, two adjacent rows are grouped by a single data electrode an arrangement pitch of which is substantially twice the cell pitch along the line direction. Shape and dimension of the data electrode are chosen such that a single data electrode is related to both the adjacent rows. In order to enable selection of an individual cell on a single one of the grouped rows by designating the one of two rows, two or more scan electrodes are arranged for a single line. The shape of the data electrode is such as to effectively confront the scan electrodes at each cell of the related two rows.

Compared with the prior art structure in which a single data electrode is provided for each row, the space d between the adjacent two data electrodes is a value p−w, where the cell pitch p is reduced from the electrode width w; in the present invention, the data electrode space d is a value reducing the electrode width w from the double of the cell pitch 2p, that is p−w.

In the displaying, a period allocated for a single line in a line sequential addressing period is divided so that the first and the second rows of each data electrode are set by time-sharing. Then, the number of the scan becomes twice the prior art method; however, when the screen is divided into two along the row direction it is possible to avoid the increase in the time required for the addressing of the whole screen by performing the addressing operation in parallel for the divided screens.

The above-mentioned features and advantages of the present invention, together with other objects and advantages, which will become apparent, will be more fully described hereinafter, with references being made to the accompanying drawings which form a part hereof, wherein like numerals refer to like parts throughout.

DETAILED DESCRIPTION OF THE PREFERRED EMBODIMENTS

Hereinafter are described firstly a surface discharge type PDP to which the present invention is typically applied to.

A surface discharge type PDP has been such a type that a pair of sustain electrodes alternately becoming anode and cathode are arranged in parallel on an inner surface of one of substrate pair for an AC drive, i.e. an alternating current drive, in order to sustain a lighting state utilizing wall charges. In this type, a long life in the operation can be expected by reducing deterioration of fluorescent material layer caused from ion bombardment of the discharge owing to the arrangement of the fluorescent material layer for the color display on the second substrate opposed to the first substrate carrying the sustain electrode pairs. In illustrating the hereinafter-described PDPs, the same numerals are denoted to the corresponding structural elements regardless to the difference in the detailed shape.

Figures 1A, 1B:
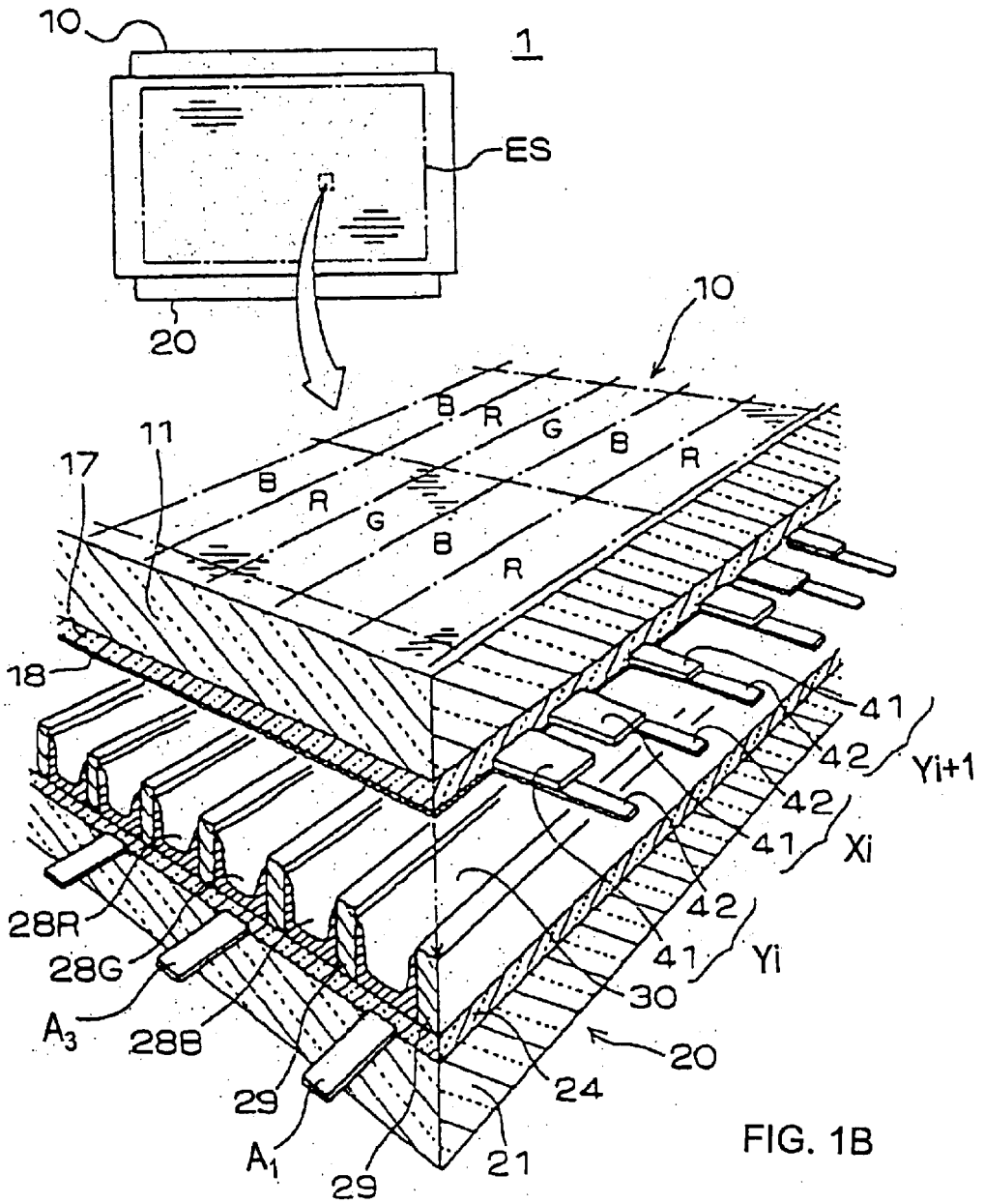
FIG. 1 is a perspective view schematically illustrating an internal structure of a first PDP of a first preferred embodiment of the present invention.

FIG. 1 schematically illustrates an internal structure of a first PDP 1 of a first preferred embodiment of the present invention.

PDP 1 is an AC type color PDP formed of paired substrates 10 & 20 where the basic structure is similar to the prior art three-electrode type surface discharge structure; except that there are provided three horizontal electrodes Yi, Xi & Yi', referred to hereinafter respectively as Yi, Xi, Yi' electrodes, extending along a line direction, i.e. along the horizontal direction in the drawing, and address electrode A, which was called as data electrode, extending along the row direction, i.e. along the vertical direction in the drawing, are crossed with each other. The Yi electrode plays both a roll of a sustain electrode for causing a surface discharge and a roll of a first scan electrode in the addressing operation; the Xi electrode plays a roll as a sustain electrode only; and the Yi' electrode plays a roll as a sustain electrode and a roll as a second scan electrode in the addressing operation as described later in detail. Each of Yi, Xi & Yi' electrodes is formed of a transparent electrically conductive film 41 and a metal film 42 stacked thereon, and is arranged on an inner surface of front glass substrate 11.

An approximately 30 $\mu$m thick dielectric material layer 17 spreads all over the display area so as to cover the Yi, Xi & Yi' electrodes. Upon a surface of dielectric material layer 17 is coated a protecting layer 18 formed of magnesium oxide (MgO). Data electrode acts as an address electrode for causing wall charges in the cell during the address period. Accordingly, the data electrodes will be referred to hereinafter as address electrodes A. Address electrodes A are arranged on an inner surface of back glass substrate 21. Upon dielectric material layer 24 covering address electrodes A are arranged separator walls 29, typically 100 $\mu$m high, 30 $\mu$m wide, equally spaced out in a shape of stripes in a plan view. Discharge space 30 is divided thereby into individual cells on each line along the line direction.

Three fluorescent material layers 28R, 28G & 28B are provided respectively to emit primary colors R (red), G (green) & B (blue) of the color display so as to cover the back substrate's inner surface including dielectric layer 24 on an upper part of address electrodes A and sides of separator walls 29. A single pixel of the display is constituted with three sub-pixels formed in each discharge space 30 and aligned along the line direction. Emitting colors of sub-pixels aligning along the row direction, that is in the valley between the two adjacent separator walls, are identical. Due to separator walls 29 having the stripe pattern in the plan view, the portion which corresponds to each row in the discharge space 30 continuously crosses over all the lines.

Figure 2:
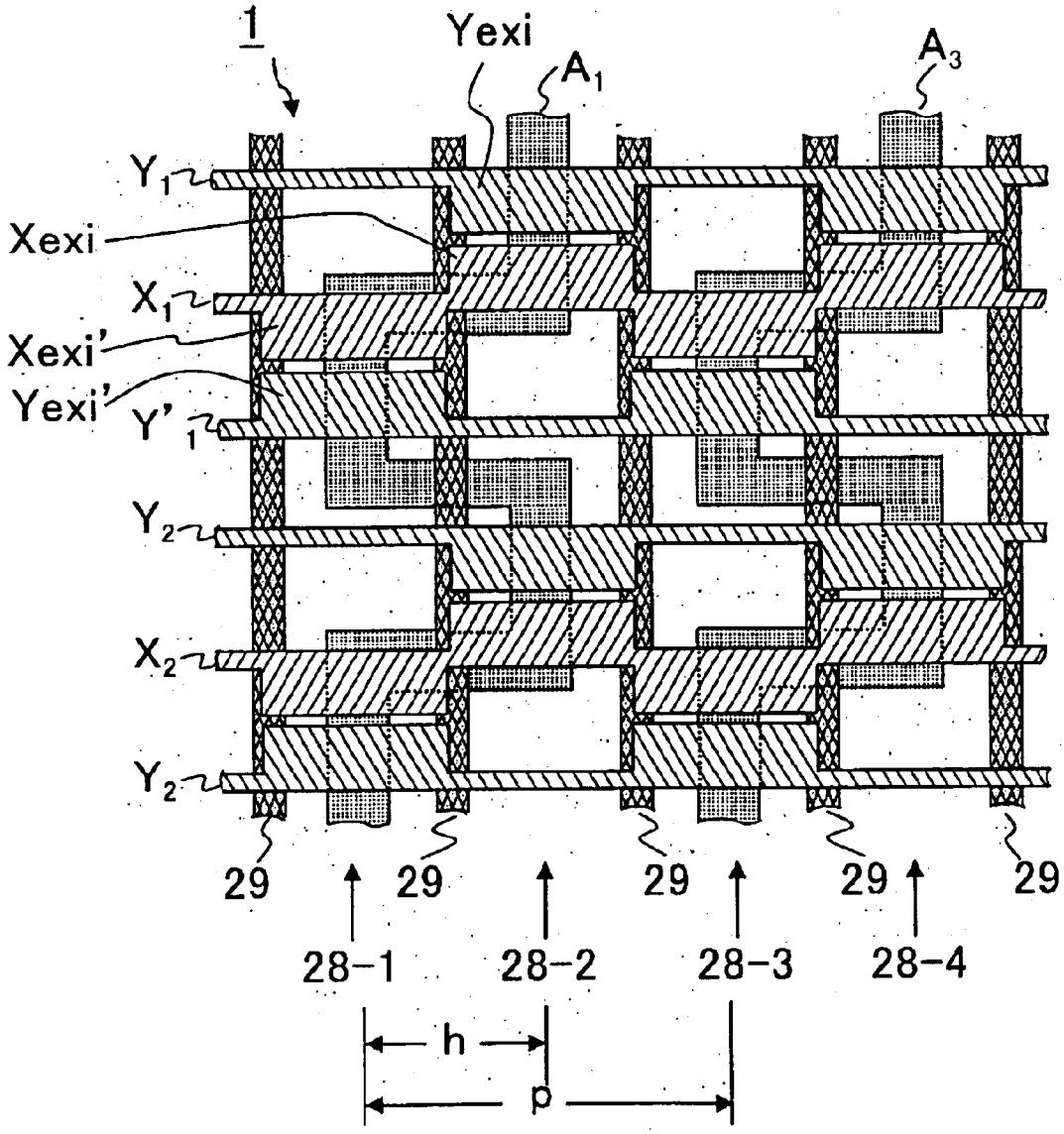
FIG. 2 is a plan view schematically illustrating an electrode structure of the first PDP.

FIG. 2 is a plan view schematically illustrating an electrode structure of first PDP 1. FIG. 3 schematically illustrate an electrode matrix of first PDP 1. In FIG. 3 are omitted the X electrodes for the simplicity of the description. A chain circle indicates a lighting center of each cell C.

First PDP 1 has two features related to the present invention as shown in FIG. 2. A first feature is in that a single address electrode A is provided for two adjacent rows instead of a single row, such that the address electrode A is patterned in a shape of regularly zig-zagging stripe so as to relate to the two adjacent rows. Another feature is in that the Yi & Yi' electrodes in pair are arranged on both the sides of each Xi electrode so that both of the X electrodes can respectively relate to the Xi electrode placed at the middle.

Xi electrodes are in a particular stripe shape arranged such that in an even numbered row, for example 28-2, each Xi electrode has a portion Xexi expanding toward Yi electrodes and in an odd numbered row, for example 28-1, another portion Xexi' alternately expanding toward Yi' electrodes. So as to meet thus expanding portions Xexi and Xexi' of the Xi electrode, Yi & Yi' electrodes are respectively patterned such that a portion, of the electrodes, Yexi & Yexi' confronting the expanding portions Xexi and Xexi' of the Xi electrode respectively expands toward the expanding portion Xexi and Xexi' of the Xi electrode alternately for every two rows. In other words, the width of each Yi & Yi' electrode is locally and periodically expanded so as to confront respectively the expanding portions Xexi or Xexi' of Xi electrode. Gaps between the confronting expanding-portions are the surface discharge gap, typically of 50 $\mu$m.

Each address electrode A is patterned to turn in a zigzag in a plan view such that after crossing over the discharge gap between the Yi electrode and the Xi electrode located in an even numbered discharge space 28-2 the address electrode horizontally turns to go to the adjacent odd numbered discharge space 28-1 and then turns to cross over another discharge gap between the Yi' electrode and the Xi electrode, and after crossing over the discharge gap between the Yi' electrode and the Xi electrode the address electrode turns to go back to the adjacent original even numbered discharge space 28-2.As described above, the practical Yi, Xi and Yi' electrodes are respectively formed of a stack of a typically 100 $\mu$m transparent electrically conductive film for enhancing the effective electrode area while avoiding shielding of the light and a metal film for supplementing the electrical conductivity. Thus shaped patterns of transparent electrically conductive films are shown in FIG. 2. The pattern of metal films of the Yi, Xi and Yi' electrode is a typically 50 $\mu$m wide straight stripe except at the expanding portions thereof. X electrodes are also formed of a stack of a typically 100 $\mu$m transparent electrically conductive film and a typically 50 $\mu$m wide metal stripe thereon.

Figure 3A:
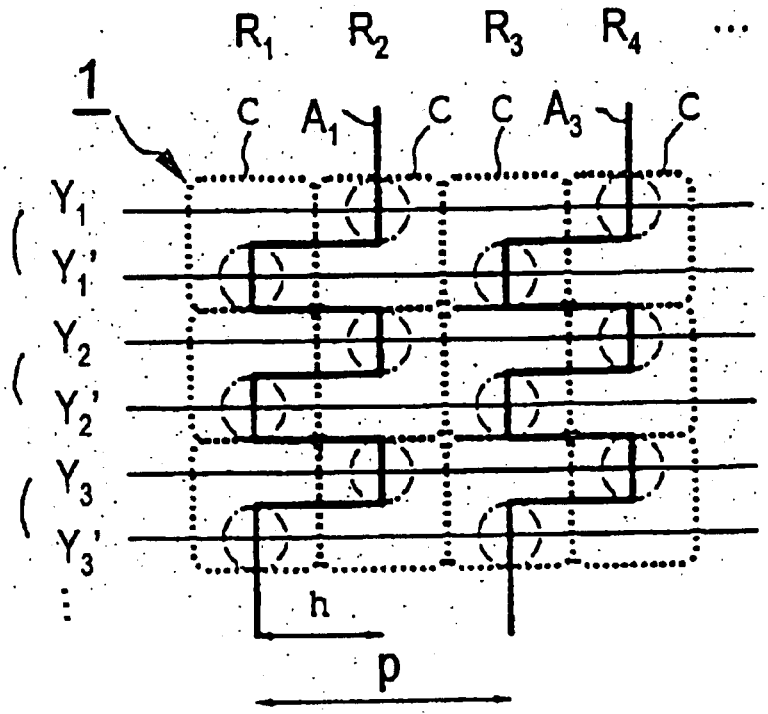
FIG. 3A and FIG. 3B schematically illustrate a matrix of electrode structure of the first PDP.
Figure 3B:
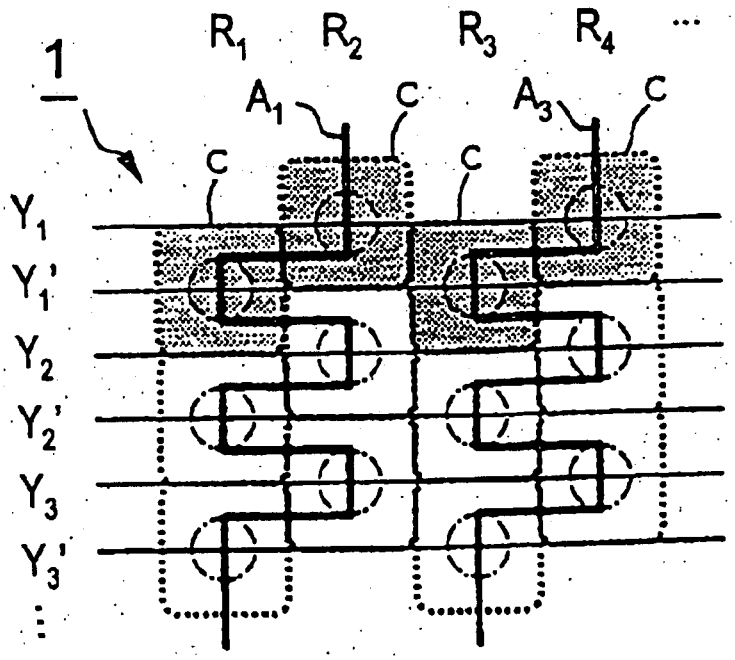

The arrangement pitch ph typically 260 $\mu$m of address electrodes A is twice the typically 130 $\mu$m cell pitch h along the line direction as shown in FIGS. 2 and 3. Accordingly, the address electrode arrangement clearance is approximately twice that of the prior art structure, so that the reactive power spent in the electrostatic capacitance between the adjacent address electrodes can be reduced down to approximately the half. In watching the two adjacent rows which relate to the address electrode therebetween, the location of lighting center of each cell C is deviated along the row direction as shown in FIG. 3B. Accordingly, if the lighting center is considered to be at the center of the cell C each line is in a zigzag having the cells deviated vertically by half a pitch pv from an odd-numbered line to an adjacent even-numbered line also as shown in FIG. 3B. In this case as well, it is needless to say that the Yi & Yi' electrodes are arranged to relate to a single line quite similarly to FIG. 3A. In this specification, a single line is a group of as many as m cells C in total having the same sequential number in the screen formed of m×n cells.

In performing the displaying of first PDP 1, the line-sequential addressing operation is first performed utilizing twice the address electrode A for each line. In other words, the addressing period, i.e. a scan period, for a single line is divided into a first half and a second half. During the first half, Yi electrode is activated, i.e. selected to scan, and at the same time a selected one of address electrodes is activated in accordance with the contents to be displayed. In practice, a pulse of a predetermined peak voltage value is applied to the so that an opposing discharge, which is a discharge in the opposing direction of the substrates, is generated between thus selected Yi electrode and thus selected first address electrode Al at a cell on an even-numbered row as denoted with 28-2 in FIG. 2.

Thus generated opposing discharge triggers a surface discharge along the gap between the expanding portion Yexi & Xexi respectively of Xi electrode and the Yi electrode. Status of wall charges in each cell on the selected line and row are thus set by the sequence of address discharges caused by the address electrode.

If the addressing operation is of an erasing type, the wall charges are erased by an addressing discharge prior to the addressing operation from the cells C selected from the charged cells on the entire screen. If a write-address type, the wall charges are formed by an address discharge only in the cells selected from non-charged cells on the entire screen.

Subsequently in the second half is activated Yi' electrode, and concurrently thereto are activated the cells in odd-numbered rows 28-1 and 28-3 . . . by addressing the address electrodes A1, A3 . . . selected in accordance with the contents to be displayed, so that the cells in the odd-numbered rows are addressed in the same way as in the first half period.

The above-described two-step addressing operation is performed sequentially on each line so as to set the charged states on the entire screen. The operations of the electrodes during the addressing operation are shown in TABLE 1, where "ON" indicates the related electrode is active to be selected.

TABLE 1

| | Yj and Yj' Electrodes | | | | | | | Data of Address/ Data Electrode $A_1$, |
|---|---|---|---|---|---|---|---|---|
| Scan | 1st | | 2nd | | . . . | $i^{th}$ lines | | $A_3$ . . . |
| Period | Y1; | Y1'; | Y2; | Y2' | . . . | Yi; | Yi' | $A_{m-1}$ |
| 1st half of 1st line | ON | — | — | — | — | — | — | data of even-numbered row |
| 2nd half of | — | ON | — | — | — | — | — | data of |

TABLE 1-continued

| | Yj and Yj' Electrodes | | | | | | | Data of Address/ Data Electrode $A_1$, |
|---|---|---|---|---|---|---|---|---|
| Scan | 1st | | 2nd | | . . . | $i^{th}$ lines | | $A_3$ . . . |
| Period | Y1; | Y1'; | Y2; | Y2' | . . . | Yi; | Yi' | $A_{m-1}$ |
| 1st line | | | | | | | | odd-numbered row |
| 1st half of 2nd line | — | — | ON | — | — | — | — | data of even-numbered row |
| 2nd half of 2nd line | — | — | — | ON | — | — | — | data of odd-numbered row |
| \| | \| | \| | \| | \| | \| | \| | \| | \| |
| 1st half of $i^{th}$ line | — | — | — | — | | ON | — | data of even-numbered row |
| 2nd half of $i^{th}$ line | — | — | — | — | | — | ON | data of odd-numbered row |

On completion of the addressing operation, sustain pules of a predetermined peak voltage are applied alternately to electrodes, where the sustain pulses are commonly applied to Y & Y' electrodes respectively without being distinguished. Accordingly, surface discharges take place on the application of the sustain pulses in the cells in which proper amount of wall charges are existing at the completion of the addressing operation so as to sustain the lighting state owing to the wall charges cyclically generated therein.

During the surface discharges the fluorescent material layers 28R, 28G and 28B shown in FIG. 1 are locally excited by an ultra-violet light radiated from the discharge gas, and emit lights of respective colors. Only the visible lights that can penetrate the front glass substrate 11 contribute to the displaying.

Figure 4:
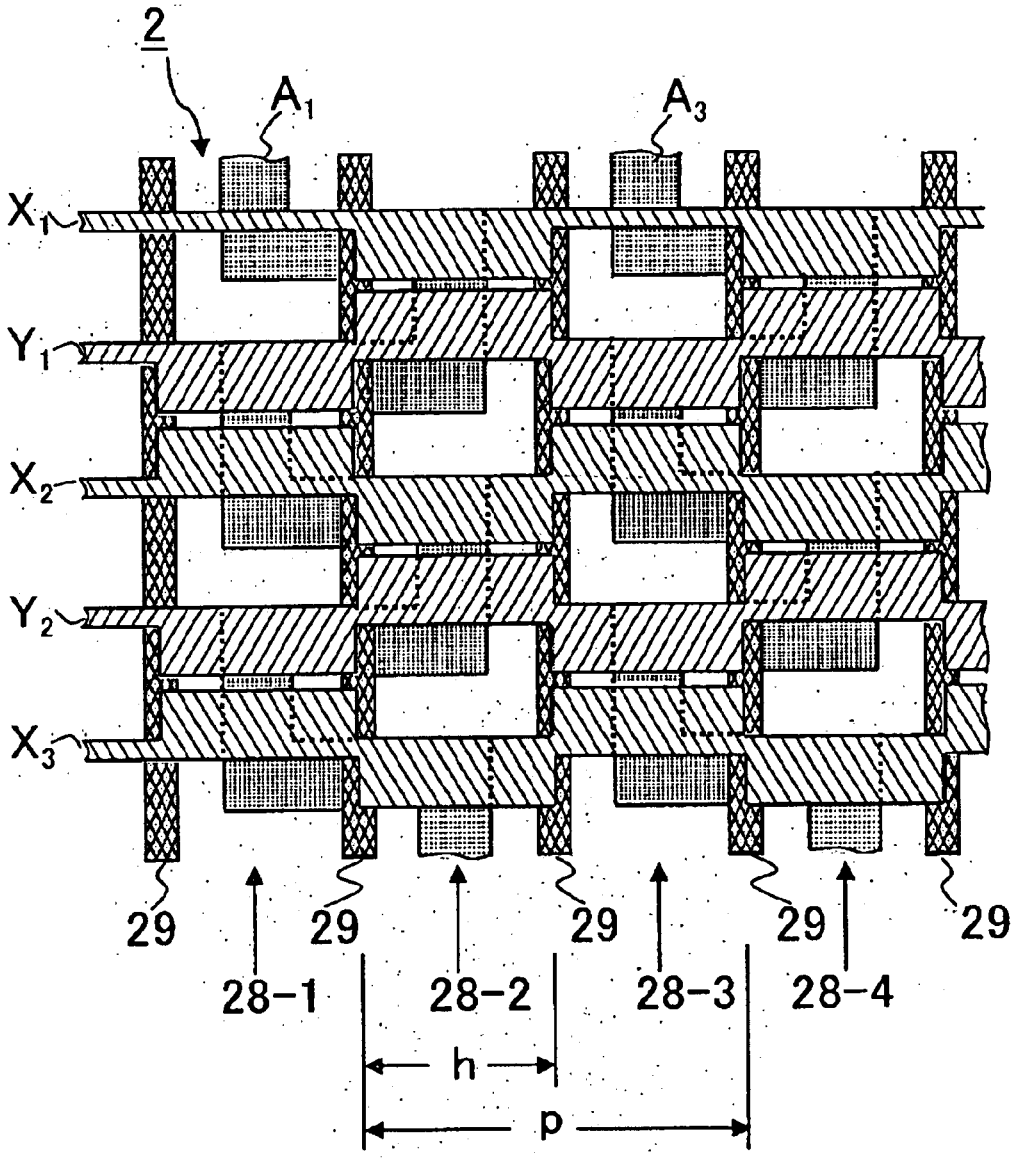
FIG. 4 is a plan view schematically illustrating an electrode structure of a second PDP.
Figure 5:
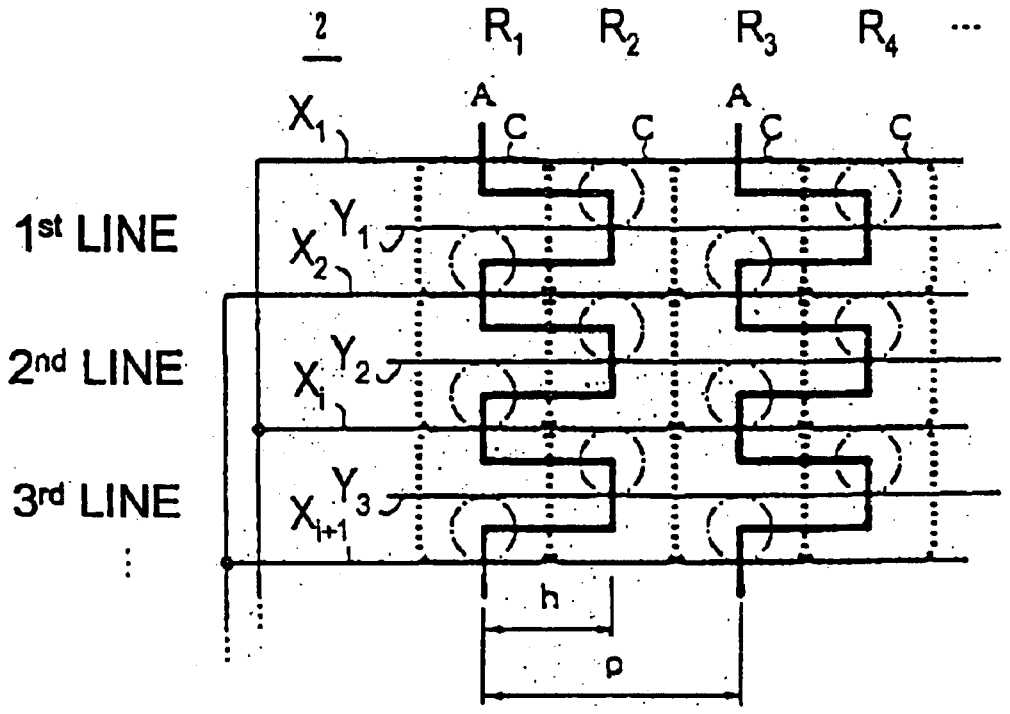
FIG. 5 is a matrix schematically illustrating an electrode structure of the second PDP.

A second preferred embodiment of the present invention is hereinafter described with reference to FIG. 4 illustrating a plan view of a second PDP 2, and FIG. 5 illustrating an electrode matrix of second PDP 2.

Second PDP 2 as well is a surface discharge type and called a reflection type, where the fluorescent material layers are placed on the back substrate similar to first PDP 1 shown in FIG. 1. It is similar to first PDP 1 as well that address electrodes A are patterned regularly in zigzag stripes relating to two adjacent rows.

Structural difference of PDP 2 from PDP 1 is in that horizontal electrodes extending the line direction are arranged repeatedly in the order of Xi, Yi, Xi+1, Yi+1 . . . by an equal clearance without idle space between Yi' and Yi+1 electrodes.

The Yi electrodes of each line play both a roll of a scan electrode in the addressing operation and a roll of a sustain electrode for causing a surface discharge in the sustain period. Xi and Xi+1 . . . electrodes play both a roll of a supplemental scan electrode for the scan electrode Yi in the addressing operation and a roll of a sustain electrode for causing a surface discharge in the sustain period as described later in detail. Accordingly, in order to name these horizontal electrodes simply, these electrodes will be referred to in the second an the subsequent preferred embodiments as an Xi electrode and Yi electrode, respectively, where the numeral i indicates an odd number. Quantity of each electrode is the quantity of the lines n in the screen. Each Yi electrode is patterned such that the width of the stripe expanding cyclically and alternately from a side thereof and from another-side for each line as denoted with Yexi and Yexi+1, where the suffix exi indicates to expand toward Xi electrode, and the suffix exi+1 indicates to expand toward Xi+1 electrode. In order to conform to thus expanded portions Yexi and Yexi+1 of the Yi electrode, Xi & Xi+1 electrodes are patterned such that a portion, of Xi & Xi+1 electrodes, confronting the expanded portions Yexi or Yexi+1 of the Yi electrode respectively expands toward the expanded portion Yexi and Yexi+1 of Yi electrode alternately for every two rows. Each address electrode A is patterned in a zigzag to sequentially cross over surface discharge gaps between the expanded portions confronting each other of Xi, Yi & Xi+1 electrodes in the similar way to the first preferred embodiment.

As seen in FIG. 5, each Yi electrode corresponds to an i-th line of the screen as an individual electrode, to which an independent potential can be applied. Each of Xi & Xi+1 electrodes located respectively at both the sides of Yi electrode respectively relates to two lines adjacent to the Yi electrode. First one X1 of the plural X electrode arrangement relates to the top line only. Last one opposite from the above-mentioned first X electrode X1 relates to the last n-th line only. Odd-numbered X electrodes X1, X3 . . . counted without distinguishing which side of Y electrode the X electrode is confronting are electrically common; and even-numbered X electrodes, X2, X4 . . . are electrically common as well.

The Y electrodes play a roll of scan electrode plus a roll of sustain electrode; and the X electrodes play a roll of supplemental scan electrode plus a roll of sustain electrode.

The arrangement pitch p of address electrodes A of second PDP 2 is twice the prior art pitch as well. Accordingly, the arrangement pitch of address electrodes becomes almost twice the cell pitch along the line direction whereby the reactive power consumed for the static capacitance can be reduced almost half.

In driving PDP 2 as well, the addressing period of a single line is divided into first and second half periods. In the first half period, the common odd-numbered X electrodes Xi, where the numeral i is now an odd number, and the i-th Y electrode Yi of the i-th line to be selected, i.e. to be scanned, are activated; and concurrently thereto address electrodes $A_1, A_2 \ldots A_{(M/2)}$ selected in accordance with the contents to be displayed are activated. The quantity of address electrodes is m/2, that is a half of the numbers m of the rows. Thereby, an address discharge takes place in the cells on the rows which relate to thus activated address electrodes among the even-numbered rows 28-2, 28-4 . . . so that a predetermined charged state is established in thus selected cells. In the second half period, the common even-numbered X electrodes Xi+1 and the same i-th Y electrode Yi of the i-th line are activated; and concurrently thereto the address electrodes selected in accordance with the contents to be displayed aare activated. Thereby, the address discharge takes place in the cells on the row which relates to thus activated address electrode among the odd-numbered rows 28-1, 28-3 . . . so that a predetermined charged state is established in thus selected cells.

Figure 15:
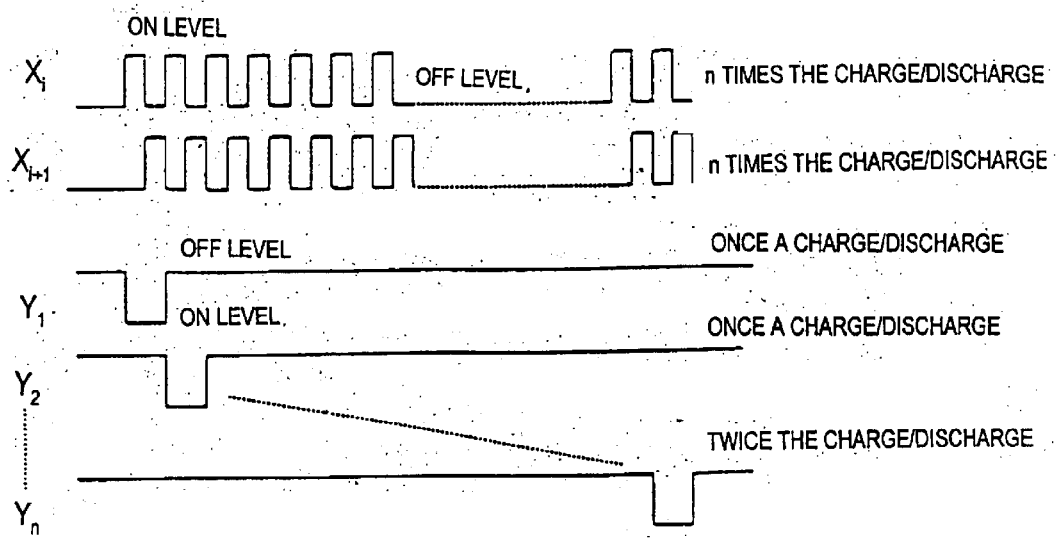
FIG. 15 schematically illustrates driving waveforms employed in addressing period of TABLE 2.

Such a two-step addressing is performed sequentially for each line so as to establish the charged state distribution on the entire screen. Driving of the electrodes during the addressing operation are shown in TABLE 2, where "ON" indicates the related electrode is active. Waveforms of the driving voltages are illustrated in FIG. 15, which will be explained later in detail.

TABLE 2

| | i: an odd number | | | | | |
|---|---|---|---|---|---|---|
| | 1st | 2nd | . . . | ith lines | | Data of Address/Data Electrodes |
| Scan Period | Y1 | Y2 | Yi | Xi | Xi + 1 | $A_1 \ldots A_{(m/2)}$ |
| 1st half of 1st line | ON | — | — | ON | — | data of even-numb'd row |
| 2nd half of 1st line | ON | — | — | — | ON | data of odd-numb'd row |
| 1st half of 2nd line | — | ON | — | ON | — | data of even-numb'd row |
| 2nd half of 2nd line | — | ON | — | — | ON | data of odd-numb'd row |
| \| | \| | \| | \| | \| | \| | \| |
| 1st half of ith line | — | — | ON | ON | — | data of even-numb'd row |
| 2nd half of ith line | — | — | ON | — | ON | data of odd-numb'd row |

On completion of the addressing period, sustain pulses of a predetermined voltage value are applied to all the X electrodes Xi & Xi+1 without being distinguished, and alternately to all the Y electrodes, as shown in FIG. 5. Thereby, the surface discharges take place every time the sustain pulses are applied so as to sustain the lighting state in the cells holding a proper amount of the wall charges at the completion of the addressing operation.

Figure 6:
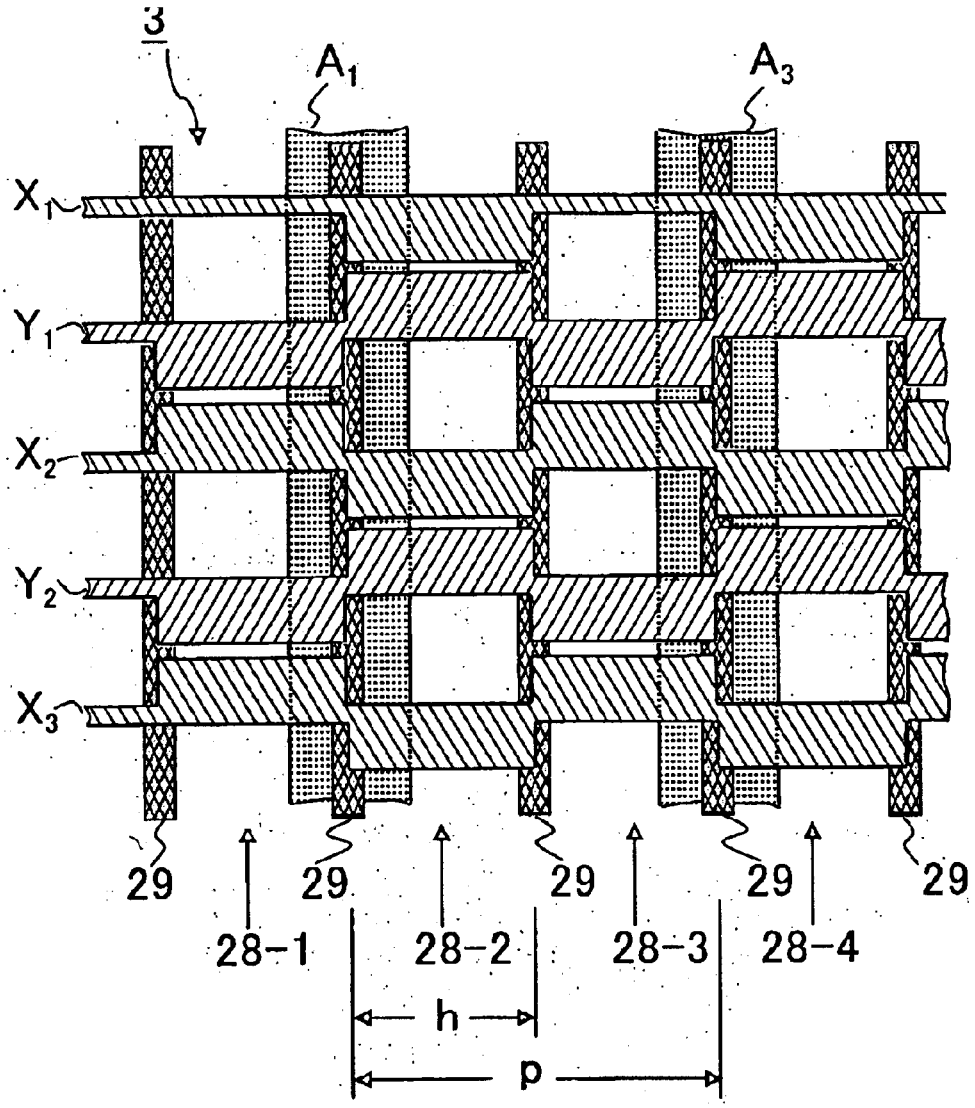
FIG. 6 is a plan view schematically illustrating an electrode structure of a third PDP.

A third preferred embodiment of the present invention is hereinafter described with reference to FIG. 6 illustrating a plan view of an electrode structure of a third PDP 3.

Third PDP 3 is a reflection type PDP as well, similar to the above-described first and second PDPs 1 and 2. Particularly, the electrode structure of front substrate is identical to that of second PDP 2 shown in FIG. 4, in which there are provided three kinds of horizontal electrodes Xi, Yi and Xi+1 arranged equally spaced out.

Feature of third PDP 3 is in that the address electrode A is patterned not in zigzag but in a wide straight stripe symmetrically relating to the adjacent two rows. Arrangement pitch p of address electrodes A is twice the cell pitch h, and the width w of address electrode A is typically 130 $\mu$m, adequately larger than typically 30 $\mu$m wide separator wall 29. In third PDP 3, owing to the straight configuration of the address electrodes it is easy to align the rows during assembling the front substrate and the back substrate. However, the wider address electrode for the easier address discharge causes the less arrangement gap between the adjacent address electrodes resulting in the less effect for reducing the capacitance.

The addressing operation in displaying third PDP 3 is identical to that of second PDP 2 described above. That is, the contents to be displayed are set sequentially line by line by twice the use of address electrode for a single line as shown in TABLE 2.

Figure 7:
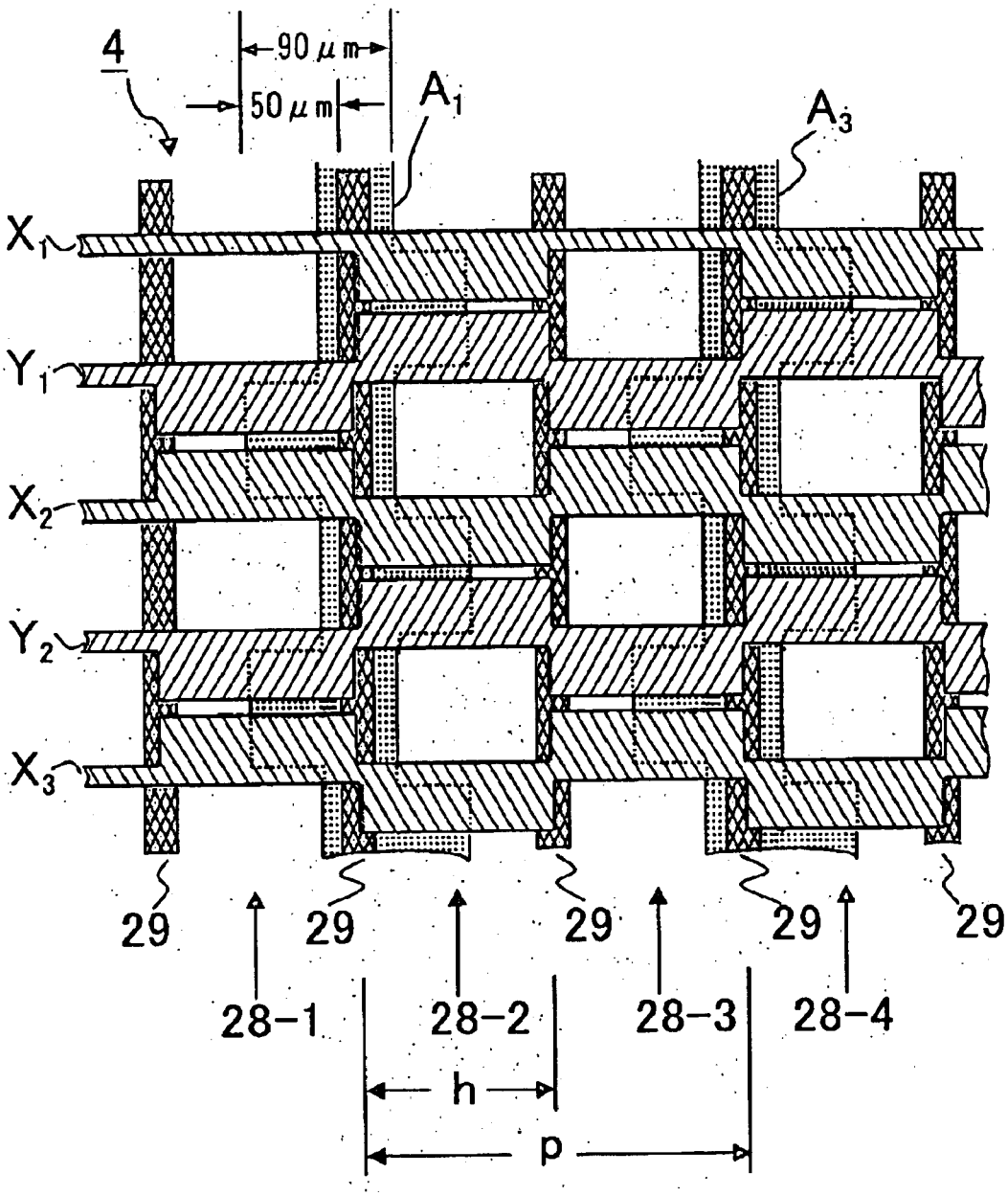
FIG. 7 is a plan view schematically illustrating an electrode structure of a fourth PDP.

A fourth preferred embodiment of the present invention is hereinafter described with reference to FIG. 7 illustrating a plan view of an electrode structure of a fourth PDP 4.

The structure of fourth PDP 4 is basically identical to those of the second and third PDPs 2 and 3 except the address electrode configuration. Address electrode A of fourth PDP 4 is formed of a particular stripe having a straight base extending straight from an end of the row to the other end and expanding portions, i.e. pads, Apad expanding alternately from a side and the other side of the base toward the line directions so as to regularly vary the width of the stripe. Width of the straight base is typically 50 μm, which is narrower than 130 μm of the third PDP 3. The expanding portions are provided so as to confront each the discharge gap in accordance with the pad arrangement of the Xi, Yi and Xi+1 electrodes. Width of the expanding portion Apad is typically 90 μm measured from the opposite straight side. Such a pattern of address electrodes A enhances the possibility of address discharges while allowing the widest clearances, typically 160 μm, between the adjacent address electrodes. Moreover, the total lengths of each address electrode A are shorter than those of address electrodes in the zigzag of first and second PDPs 1 and 2 so as to lessen the power consumption generated by the electrical resistance of the address electrodes. The addressing operation in displaying fourth PDP 4 is identical to those of second and third PDPs 2 and 3 described above.

Figure 8:
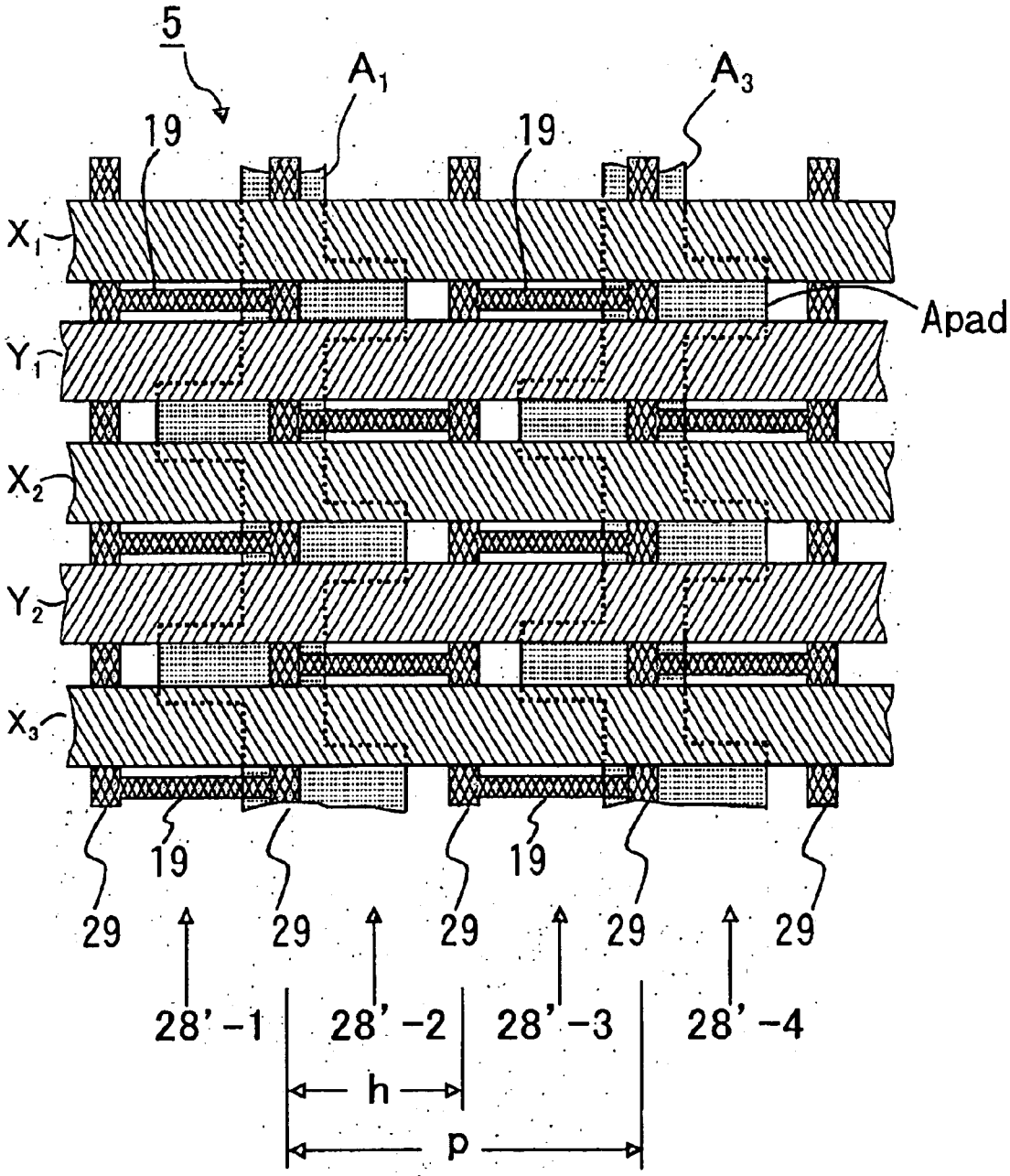
FIG. 8 is a plan view schematically illustrating an electrode structure of a fifth PDP.
Figure 9A:
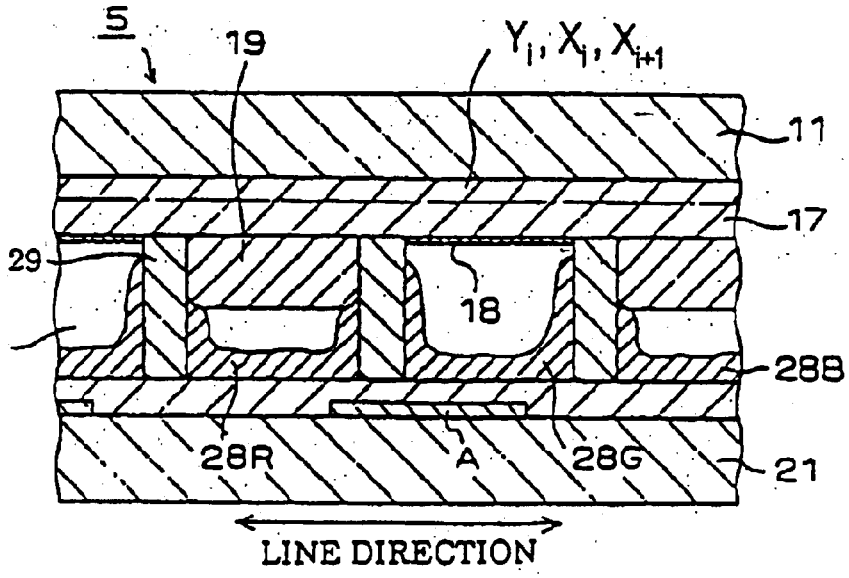
FIG. 9A is a cross-sectional view cut along the line direction schematically illustrating the fifth PDP.
Figure 9B:
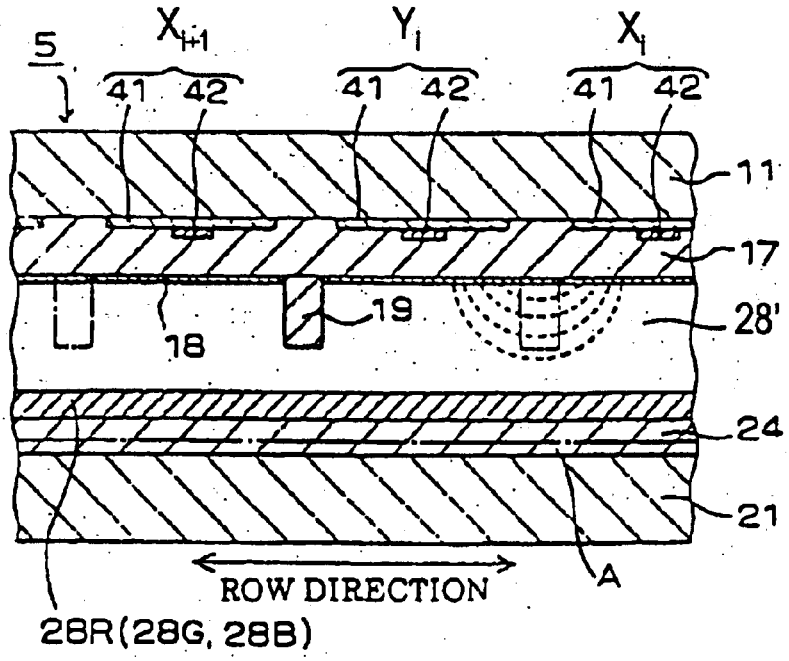
FIG. 9B is a cross-sectional view cut along the row direction schematically illustrating the fifth PDP.

A fifth preferred embodiment of the present invention is hereinafter described with reference to FIG. 8 illustrating a plan view of an electrode structure of the fifth PDP 5, and FIG. 9A and FIG. 9B illustrating perspective cut views of main portion of fifth PDP 5.

Fifth PDP 5 is a reflection type PDP similar to the above-described second, third and fourth PDPs 2, 3 and 4. Particularly, the structure of address electrode is identical to that of fourth PDP 4 shown in FIG. 7.

Structural feature of fifth PDP 5 is in that the Yi, Xi, Yi' electrodes are patterned in straight stripes of respectively 10 constant width and in that there are provided second separator walls 19 to partially connect the adjacent separator walls 29 so as to prevent unnecessary discharge coupling along the row direction. Each of Yi, Xi, Yi' electrodes is formed of a stack of a wide, i.e. typically 150 μm, transparent electrically conductive electrode 41 and a narrow, i.e. typically 50 μm wide, metal film 42 stacked thereon at the center of the width of transparent electrically conductive electrode 41 as shown in FIG. 9. The straight Yi, Xi, Yi' electrodes are advantageous for better yield in the production than the Yi, Xi, Yi' electrodes having alternate pads of the fourth preferred embodiment because the patterning accuracy is not so required as the fourth preferred embodiment, and are advantageous also in enhancing more brightness owing to the wide electrode width.

However, the equally spaced clearance between the Yi, Xi, Yi' electrodes may cause an undesirable discharge at an undesirable place there between. Accordingly, in order to prevent the undesirable discharge caused from the equally spaced clearance between the Yi, Xi, Yi' electrodes there are provided in fifth PDP 5 second separator walls 19 for dividing the discharge space 28' to each line on insulating layer 17 on the inner surface of front substrate 11. Similarly to the previous preferred embodiments the cell positions in the odd-numbered row and the even-numbered row are shifted along the row direction. Accordingly, the location of second separator wall 19 is shifted by a half pitch in the adjacent row. The height of second separator 19 is lower than that of first separator wall 29 so that the gas in the discharge space can be exhausted and refilled therein after the substrates are assembled together, and moreover, so that a priming effect can be kept between the cells in the row. If the substrates are to be assembled in vacuum or in an atmosphere of the discharge gas, the second separator wall 19 can be high enough to completely partition the discharge space 28' into each cell.

In stead of providing second separator wall 19 there may be provided a dielectric layer having a higher dielectric constant than that of insulating layer 17 buried therein, or having a lower secondary-emission constant, or a barrier electrode.

The addressing operation in displaying fifth PDP 5 is identical to those of second to fourth PDPs 2 to 4 described above.

Figure 10:
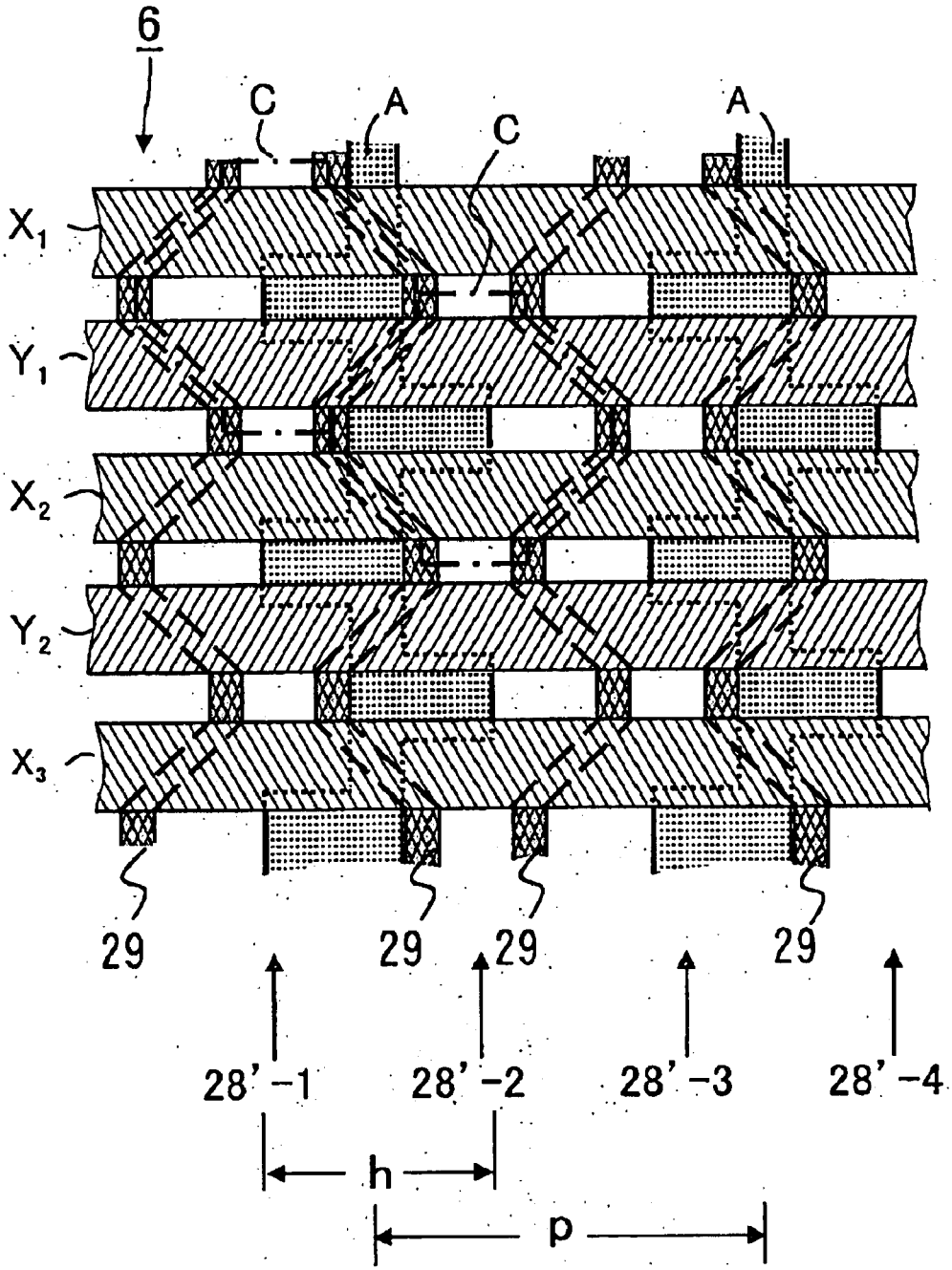
FIG. 10 is a plan view schematically illustrating electrode structure of a sixth PDP.
Figure 11:
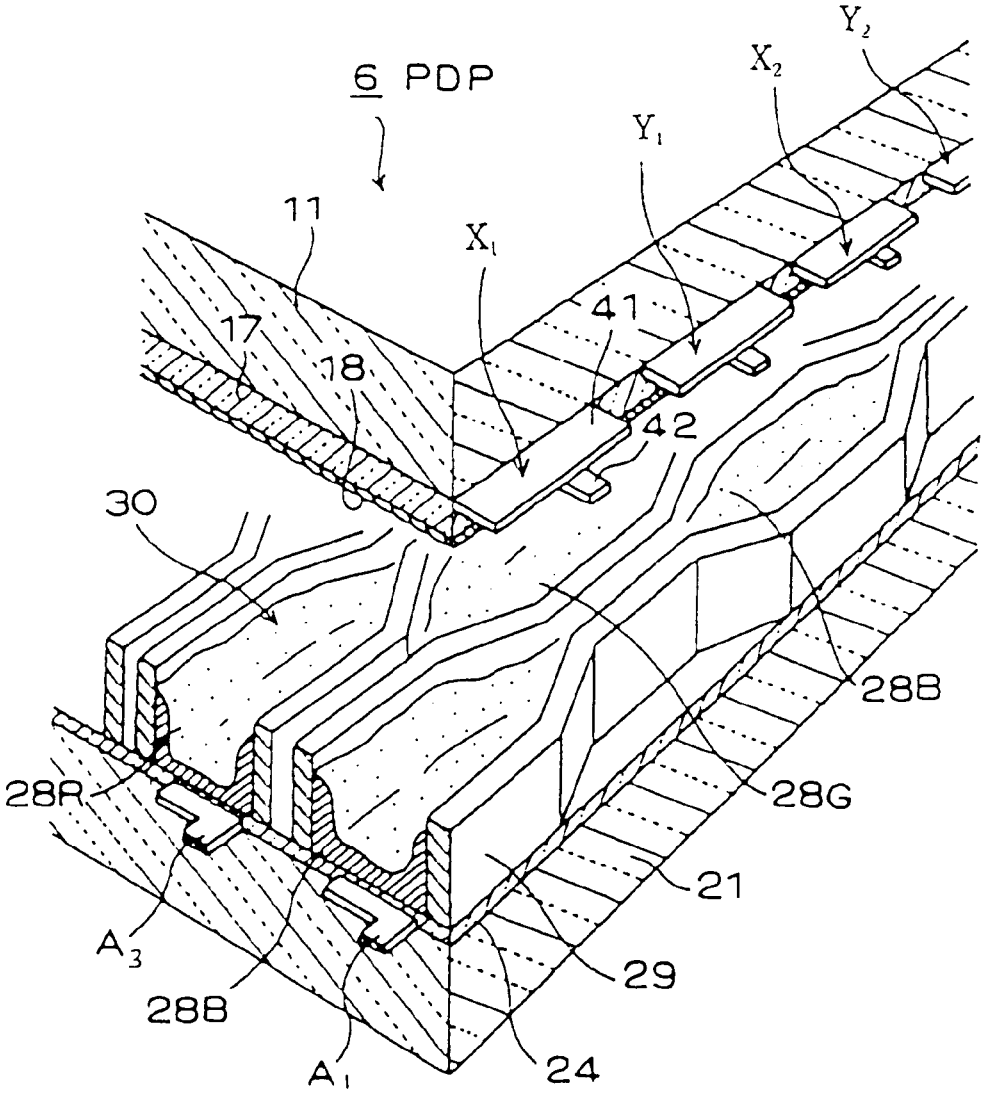
FIG. 11 is a perspective view schematically illustrating a structure of separator walls of the sixth PDP.

A sixth preferred embodiment of the present invention is hereinafter described with reference to FIG. 10 illustrating a plan view of an electrode structure of a sixth PDP 6, and FIG. 11 illustrating a perspective cut view of separator wall structure of sixth PDP 6.

Sixth PDP 6 is a reflection type PDP as well, where the electrode structure is basically similar to fifth PDP 5 shown in FIG. 8 except that the plan view of address electrodes is narrower than that of the fifth preferred embodiment and the plan view of the shape of separator wall is different as described later. Address electrode A of sixth PDP 6 as well is in a stripe shape the width of which varies between the straight base portion and the expanding portions.

The most important feature of sixth PDP 6 is in that discharge space 30 is divided with zigzagging stripes of separator walls 29'. That is, each separator wall 29' is arranged in zigzag of a predetermined pitch and in an amplitude in the plan view so that a clearance between the adjacent separator wall 29' becomes smaller than a predetermined value cyclically along the row direction. The predetermined value is such a dimension as to inhibit the discharge, and is determined by discharge condition such as the gas pressure. Separator walls are separated along the line direction from the adjacent separator wall; accordingly, the space between each separator wall 29, that is, the row space, is continuous to cross-over all the lines. Accordingly, the uniformly-aligning process of fluorescent material layers 28R, 28G and 28B and the exhausting process after assembled are easier than those of the fifth PDP 5 where the internal space is divided along both the row direction and line direction. The electrode dimensions are substantially same as those of FIG. 4.

Providing that the numeral i indicates an odd number, the expanding portion Aexo confronting the surface discharge gap gi between Xi electrode and Yi electrode is located on the odd-numbered row R1, R3 . . . , that is on the left hand side of the address electrode in the figure. The expanding portion Aexe confronting the surface discharge gap gi' between Yi electrode and Yi+1 electrode is located on the even-numbered row R2, . . . This relationship is drawn in FIG. 8 in a fashion reversed from that of the fifth PDP 5. Such difference in the shape of address electrodes does not give an effect on the driving characteristics. However, in activating the Xi electrode, e.g. X1, together with Y electrode having the same suffix number, e.g. Y1, during the first half of the address period the address electrode must be activated with the data of the odd-numbered row; while in activating the even numbered electrode Xn+1, together with Y electrode having the same suffix number, e.g. Y2, the address electrode must be activated with the data of the even-numbered row.

The surface discharge does not take place at the discharge space having the small width 50 μm in the line direction. The surface discharge takes place in the discharge space having the wide width 150 μm between the separator walls adjacent along the line direction, and between confronting Yi electrode and Xi+1 electrode so as to form a single cell. Accordingly, the cells are aligned in zigzag along both the row direction and the line direction. In sixth PDP 6, the three zigzaggingly adjacent cells respectively of R, G and B constitute a single pixel. In other words, the arrangement form of three colors for the color display is of a triangle form, or a delta form arrangement. The expanding portions Aexo and Aexe of address electrodes are arranged so as to respectively confront the surface discharge gaps.

At the Xi, Yi electrodes, both the sides thereof toward the row direction are involved in the surface discharges except the sustain electrode at the arrangement ends. Accordingly, a metal film, i.e. a 50 $\mu$m wide bus conductor, is stacked along the center of the width 150 $\mu$m of transparent electrically conductive film 41 similarly to fifth PDP 5.The zigzag configuration of separator walls 29' allows an enhancement of the brightness owing to the wider discharge space of each cell C than the case where the separator walls are simply straight.

Driving of each electrode during the addressing period in displaying sixth PDP 6 is shown in TABLE 3, which is basically identical to those of TABLE 2; however, the combination of the voltage applications to the Xi, Yi, Xi+1 electrodes and the row data to be applied to the address electrode A is different from that of TABLE 2. In the table, "ON" indicates to activate the related electrode.

TABLE 3

| | i: an odd number | | | | | |
|---|---|---|---|---|---|---|
| | 1st | 2nd | . . . | ith lines | | $A_1$, |
| Scan Period | Y1 | Y2 | Yi | Xi | Xi + 1 | A3 . . . $A_{(m/2)}$ |
| 1st half of 1st line | ON | — | — | ON | — | data of even-numb'd row |
| 2nd half of 1st line | ON | — | — | — | ON | data of odd-numb'd row |
| 1st half of 2nd line | — | ON | — | ON | — | data of even-numb'd row |
| 2nd half of 2nd line | — | ON | — | — | ON | data of odd-numb'd row |
| — | — | — | — | — | — | — |
| \| | \| | \| | \| | \| | \| | \| |
| — | — | — | — | — | — | — |
| 1st half of ith line | — | — | ON | ON | — | data of even-numb'd |
| 2nd half of ith line | — | — | ON | — | ON | |

Figure 12:
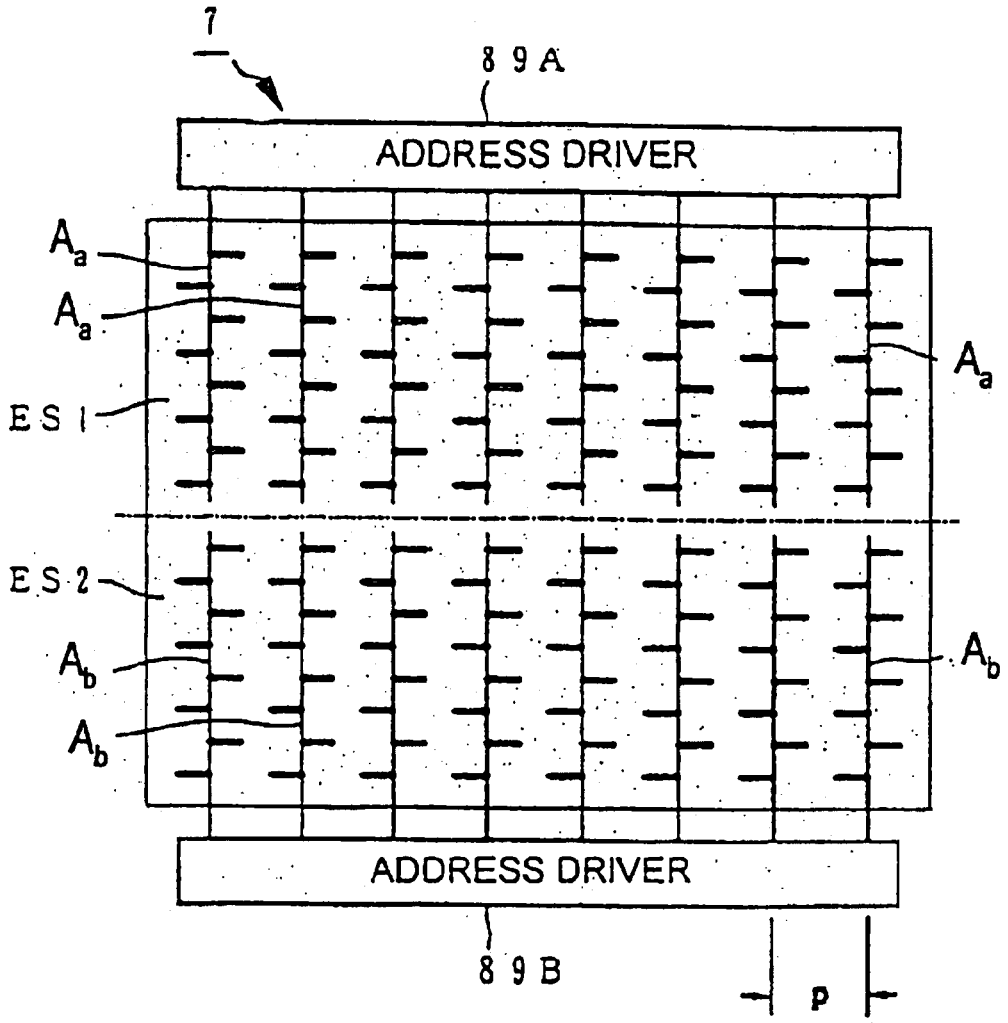
FIG. 12 is a plan view schematically illustrating an electrode structure of a seventh PDP.

FIG. 12 schematically illustrates an address electrode structure of a seventh PDP 7, where the address electrode configuration is basically identical to those of the fourth to sixth preferred embodiments PDPs 4 to 6 in that the expanded portions are cyclically and alternately extended from the sides. The entire screen of seventh PDP 7 is divided into two divided screens ES1 & ES2 in the row direction. In each of the divided screens ES1 & ES2, address electrodes A are arranged along the line direction spaced by p, twice the cell pitch h. Address electrodes Aa in the upper divided screen ES1 is driven by a first address driver 89A; and address electrodes Ab in the lower divided screen ES2 is driven by a second address driver 89B. In other words, the divided screens ES1 & ES2 are constituted so that the divided screens can be driven independently from each other. The plan view shape of the address electrodes is identical to those of fifth and sixth PDPs 5 and 6, where the width of the address electrode varies cyclically.

Address electrodes being arranged by one for two rows allows approximately a half the prior reactive power consumption caused from the static capacitance between the address electrodes; however, the time required in addressing a single line is doubled. However, the concurrent addressing of both the divided screens ES1 & ES2 allows an achievement of the whole screen addressing in a time equal to that of the prior method.

Figure 13:
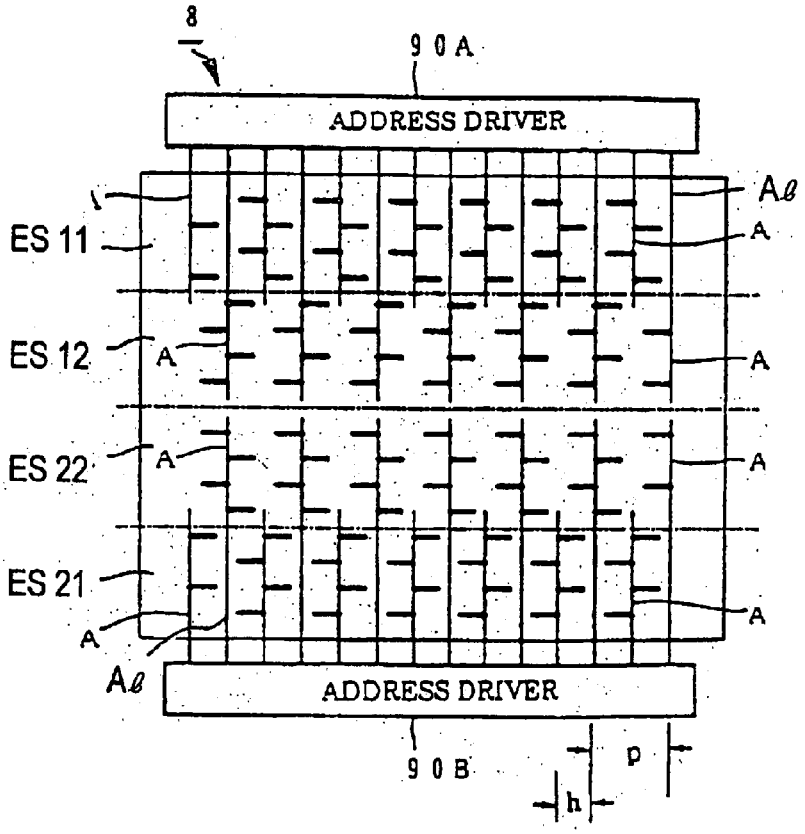
FIG. 13 is a plan view schematically illustrating an electrode structure of a eighth PDP.
Figure 14:
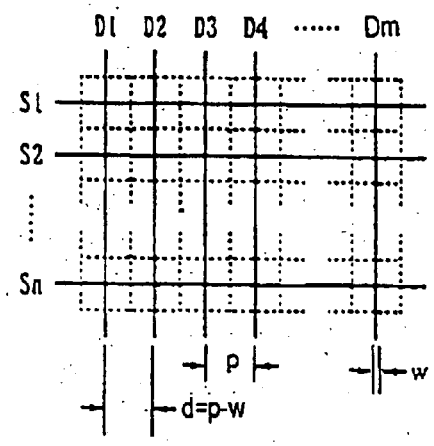
FIG. 14 PRIOR ART
FIG. 14 is a matrix schematically illustrating an electrode structure of a prior art PDP.

FIG. 13 schematically illustrates an electrode structure of an eighth PDP 8 as an eighth preferred embodiment of the present invention.

The entire screen of the eighth PDP 8 is divided into four in the row direction. In each divided screen ES11, ES12, ES21 & ES22 are respectively arranged address electrodes All, A12, A21 & A22 spaced out by a pitch p:260 $\mu$m, i.e. twice the cell pitch h:130 $\mu$m, in the line direction so as to be involved in adjacent rows. In the most upper divided screen, i.e. a first screen, ES11, there is further provided between adjacent address electrodes a lead conductor Al which is an extension of address electrode of the second divided screen ES12 so as to feed the address electrode thereof. In the similar way, in the lowest divided screen, i.e. a fourth screen, ES12, there is further provided between adjacent address electrodes a lead conductor Al which is an extension of address electrode of the third divided screen ES22. Accordingly, in the first and fourth screens ES11 & ES21 the arrangement pitch of address electrodes including those of the two central screens, i.e. the second & third screens ES12 & ES22, become substantially equal to that of the cell pitch. Therefore, the particular screen of the present invention described above is related to the two central divided screens ES12 & ES22.

Two upper divided screens ES11 & ES12 are driven by a first address driver 90A, and two lower divided screens ES21 & ES22 are driven by a second address driver 90B. Thus, four divided screens ES11, ES12, ES21 & ES22 can be driven independently from each other. Such a parallel addressing operation reduces the addressing period required for addressing the entire screen to a half of the prior method.

Waveforms typically employed in TABLE 2 during the address period is illustrated in FIG. 15. As seen there, the first and second halves of the addressing is performed for each line requiring as many as n pulses for Xi electrodes & Xi+1 electrodes, respectively, where n indicates the quantity of Y electrodes.

FIG. 15 and TABLE 4 schematically illustrate waveforms and time sequence of a ninth preferred embodiment of the present invention. The ninth preferred embodiment is an improved alternative method to drive during the addressing period the PDPs having the Xi, Yi & Xi+1 electrode arrangements of the second to eighth preferred embodiments.

Figure 16:
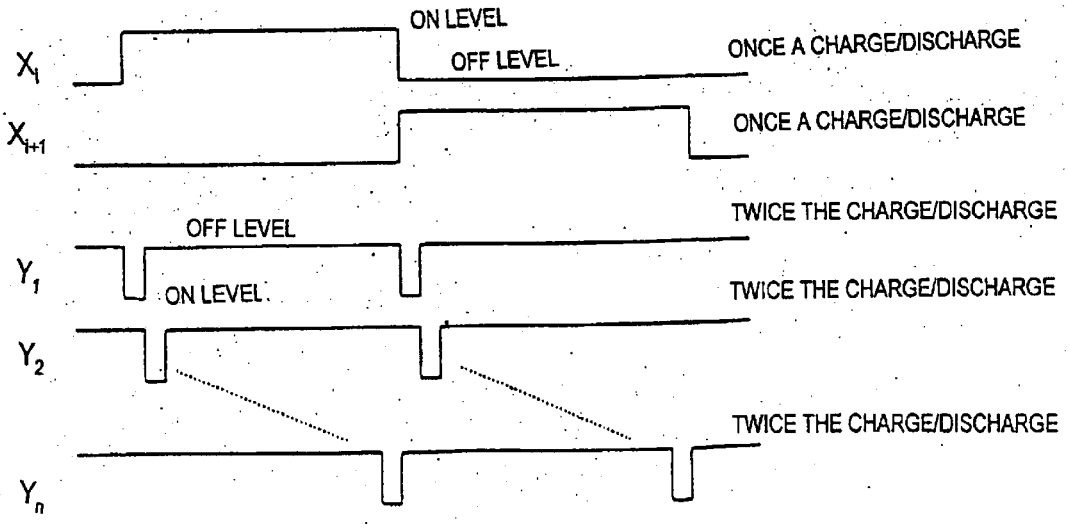
FIG. 16 schematically illustrates driving waveforms of a ninth preferred embodiment.

In the ninth preferred embodiment, all of the first halves of the addressing periods are processed first so that each Yi electrodes and the related odd-numbered Xi electrodes are sequentially activated while continuously keeping all the odd-numbered Xi electrodes ON; next, all of the second halves of the addressing periods are processed so that each Yi electrodes and the related even-numbered Xi+1 electrodes are sequentially activated while continuously keeping all the even-numbered Xi+1 electrodes ON. This driving method is advantageous over the driving method shown in TABLE 2 & 3 and FIG. 16, where the odd-numbered Xi electrodes and even-numbered Xi+1 electrodes are driven for each alternate first and second half of the addressing periods; accordingly, the power required in driving the X electrodes is n times of the ninth preferred embodiment.

TABLE 4

| | i: an odd number | | | | | |
|---|---|---|---|---|---|---|
| | 1st | 2nd | . . . | ith lines | | Data of Address/ Data Electrodes |
| Scan Period | Y1 | Y2 | Yi | Xi | Xi + 1 | $A_1 \ldots A_{(m/2)}$ |
| 1st half of 1st line | ON | — | — | ON | | data of even-numb'd row |
| 1st half of 2nd line | — | ON | — | ON | | data of even-numb'd row |
| : | | | — | | | : |
| : | | | | — | | : |
| 1st half of nth Line | — | — | ON | ON | — | data of even-numb'd row |
| 2nd half of 1st line | ON | — | — | — | ON | data of odd-numb'd row |
| 2nd half of 2nd line | — | ON | — | — | ON | data of odd-numb'd row |
| : | | | | | | |
| : | | | | | | |
| 2nd half of nth line | | | ON | | ON | data of odd-numb'd row |

Though in the above description are referred to surface-discharge type PDPs embodied in the reflection type, it is apparent that the present invention can be embodied in a transmission type PDPs provided with fluorescent material layers 28R, 28G & 28B on the front substrate. In the transmission type PDPs, owing to the three kinds of sustain electrodes arranged on the back substrate no transparent electrically conductive material is necessary in forming these electrodes.

It is apparent that the present invention can also be embodied in an opposing discharge type PDP, an LCD, i.e. a liquid crystal display device and a PALC, i.e. a plasma-addressed liquid crystal device.

The many features and advantages of the invention are 15 apparent from the detailed and thus, it is intended by the appended claims to cover all such features and advantages of the methods which fall within the true spirit and scope of the invention. Further, since numerous modifications and changes will readily occur to those skilled in the art, it is not detailed to limit the invention and accordingly, all suitable modifications are equivalents may be resorted to, falling within the scope of the invention.

What is claimed is:

1. A display panel having a display matrix of lines and rows crossing each other, comprising:

a plurality of scan electrodes extending along a direction of the lines;

a plurality of data electrodes extending along a direction of the rows each of the data electrodes being allocated to and bridging two adjacent rows, a specific display area being formed of a plurality of sequential lines and encompassing an entire screen or a part of the screen; and each set of two or more scan electrodes is allocated to one of said lines so that one or more of the scan electrodes in each said set are interactable for addressing with each of the data electrodes, in the respective two adjacent rows to which each data electrode is allocated.

2. The display panel as recited in claim 1, wherein each said set of scan electrodes comprises:

first and second discrete electrodes and a voltage is appliable to each of the first and second discrete electrodes of one set independent of other sets of scan electrodes.

3. The display panel as recited in claim 1, wherein each said set of scan electrodes in said specific display area comprises:

a discrete electrode, as one of said scan electrodes of the set of scan electrodes, to which a voltage is appliable independent of other scan electrodes; and a first common electrode and a second common electrode, as two other electrodes of said scan electrodes of the set of scan electrodes, arranged so as to place said discrete electrode therebetween, said first common electrode being electrically common, and said second common electrode being electrically common.

4. The display panel as recited in claim 1, wherein each of said data electrodes in said specific display area is formed in a shape of a straight stripe extending from an end of said two adjacent rows in said specific display area to another end thereof.

5. The display panel as recited in claims 1, wherein each of said data electrodes in said specific display area is formed in shape of a regularly zigzagging stripe extending from an end of a row in said specific display area to another end thereof.

6. The display panel as recited in claim 1, wherein each of said data electrodes in said specific display area is formed of a stripe, a width of which regularly varies, such that said stripe is formed of a base extending straight from an end of said two adjacent rows in said specific display area to another end thereof and portions expanding alternately from a side and from another side of said base in said line direction.

7. The display panel as recited in claim 1, wherein each of said scan electrodes comprises:

portions expanding alternately from a side and from another side of each of said scan electrodes in said row direction such that said expanding portions of each of said scan electrodes confronts adjacent expanding portions of adjacent scan electrodes, gaps between corresponding confronting expanding portions forming surface discharge gaps.

8. The display panel as recited in claim 1, wherein two of said scan electrodes are allocated to each of said lines.

9. The display panel as recited in claim 1, wherein three of said scan electrodes are allocated to each of said lines.

10. The display panel as recited in claim 6, further comprising:

a separator wall dividing a discharge space corresponding to each row at least in said specific display area into each line.

11. The display panel as recited in claim 6, further comprising:

separator walls in a zigzag extending along said row direction such that a width in said line direction of a discharge space, which corresponds to each row, is narrowed for every two adjacent lines at least in said specific display area.

12. The display panel as recited in claim 1, wherein said screen is formed of two divided display areas adjacent in said row direction, in each of said divided display areas data to be displayed is settable independent of each other, each of said divided display areas being said specific display area.

13. The display panel as recited in claim 1, wherein said specific display area is formed of four divided display areas side by side along said row direction, in each of said divided display areas data to be displayed is settable independent of each other, and wherein each of electrical leads of data electrodes of two inner divided display areas are arranged between electrical leads of two adjacent data electrodes of adjacent outer divided display areas.

14. A driving method of driving a display panel having a display matrix of lines and rows crossing each other having a plurality of scan electrodes extending along a direction of the lines, a plurality of data electrodes extending along a direction of the rows, each of the data electrodes being allocated to and bridging two adjacent rows, a specific display area being formed of a plurality of sequential lines and encompassing an entire screen or a part of the screen, and each set of two or more scan electrodes is allocated to one of said lines so that one or more of said scan electrodes in each said set are interactable for addressing with each of the data electrodes corresponding to either one of said two adjacent rows such that each of the data electrodes and the one or more scan electrodes in each said set at each intersection therebetween interact for addressing, and each said set of scan electrodes in said specific display area comprises a discrete electrode, as one of said scan electrodes of the set of scan electrodes, to which a voltage is appliable independent of other scan electrodes, and a first common electrode and a second common electrode, as two other electrodes of said scan electrodes of the set of scan electrodes, arranged so as to place said discrete electrode therebetween, said first common electrode being electrically common, and said second common electrode being electrically common, said method comprising:

setting data to be displayed on a line in said specific display area by dividing a period into a first half period and a second half period, during said first half period a first one of said two adjacent rows associated with each of said data electrodes performs said setting of said data onto a first display cell formed between the first common electrode and the data electrode, and during said second half period a second one of said two adjacent rows associated with each of said data electrodes performs said setting of said data onto a second display cell formed between the second common electrode and the data electrode.

15. The driving method as recited in claim 14, wherein said discrete electrode and said first common electrode are used in setting said data during said first half period, and said discrete electrode and said second common electrode are used in setting data during said second half period.

16. The driving method as recited in claim 15, wherein said setting of said data comprises:

setting said data of said first half period sequentially for more than two lines; and setting said data of said second half period for said more than two lines.

17. A method to drive a display panel having a display matrix of lines and rows crossing each other having a plurality of scan electrodes extending along a direction of the lines, a plurality of data electrodes extending along a direction of the rows, each of the data electrodes being allocated to and bridging two adjacent rows, a specific display area being formed of a plurality of sequential lines and encompassing an entire screen or a part of the screen, three of said scan electrodes correspond to each of said lines so that one or more of the three scan electrodes are interactable for addressing with each of the data electrodes, in the respective two adjacent rows to which each data electrode is allocated, and said three scan electrodes comprise:

a discrete electrode to which a voltage is appliable independent of other lines, and a first common electrode and a second common electrode so as to place said discrete electrode therebetween, said first common electrode being electrically common to first common electrodes of other lines, and said second common electrode being electrically common to second common electrodes of said other lines, said method comprising:

dividing a period to set data to be displayed on a plurality of lines into a first half period and a second half period;

during said first half period, each of said data electrodes performing said setting of the data of a first one of said two adjacent rows associated with said data electrode onto a first display cell formed between said first common electrode and said data electrode by said first common electrode and said discrete electrode; and during said second half period, each of said data electrodes performing said setting of the data of a second one of said two adjacent rows associated with said data electrode onto a second display cell formed between said second common electrode and said data electrode by said second common electrode and said discrete electrode.

18. A driving method of driving a display panel having a display matrix of lines and rows crossing each other, comprising:

dividing a period to set data to be displayed on a plurality of lines into a first half period and a second half period;

setting the data of a first one of two adjacent rows during said first half period onto a first display cell formed between a first common electrode and a data electrode; and setting the data of a second one of said two adjacent rows during said second half period onto a second display cell formed between a second common electrode and the data electrode, wherein the setting of the data in the first half period is performed between the first common electrode and a discrete electrode and the setting of the data in the second half period is performed between the second common electrode and said discrete electrode.

19. A display panel having a display matrix of lines and rows crossing each other, comprising:

a plurality of scan electrodes extending along a direction of the lines;

a plurality of data electrodes extending along a direction of the rows, each of the data electrodes being allocated to and bridging two adjacent rows, a specific display area being formed of a plurality of sequential lines and encompassing an entire, or a part of, a screen;

the plurality of scan electrodes being arranged in plural sets, each set comprising a common number of adjacent scan electrodes defining a corresponding line; and intersections between each data electrode and commonly selected scan electrodes of each of the plural sets thereof, in the respective two adjacent rows to which each data electrode is allocated, interacting for addressing.

20. A driving method of driving a display matrix of a display panel having a plurality of scan electrodes extending along a direction of the lines;

a plurality of data electrodes extending along a direction of the rows, each of the data electrodes being allocated to and bridging two adjacent rows, a specific display area being formed of a plurality of sequential lines and encompassing an entire, or a part of, a screen;

the plurality of scan electrodes being arranged in plural sets, each set comprising a common number of adjacent scan electrodes defining a corresponding line; and intersections between each data electrode and commonly selected scan electrodes of each of the plural sets thereof, in the respective two adjacent rows to which each data electrode is allocated, interacting for addressing, said method comprising:

setting data to be displayed on a line in said specific display area by dividing a period into a plurality of periods, during a first period a first one of said two adjacent rows associated with each of said data electrodes performs said setting of said data onto a first display cell formed between a first common electrode and the data electrode, and during a second period a second one of said two adjacent rows associated with each of said data electrodes performs said setting of said data onto a second display cell formed between a second common electrode and the data electrode.

* * * * *

UNITED STATES PATENT AND TRADEMARK OFFICE

CERTIFICATE OF CORRECTION

PATENT NO. : 6,727,869 B1
DATED : April 27, 2004
INVENTOR(S) : Tadayoshi Kosaka

It is certified that error appears in the above-identified patent and that said Letters Patent is hereby corrected as shown below:

Column 14,
Line 18, change “claims” to -- claim --.

Column 15,
Line 21, after “comprises” insert -- : --.

Signed and Sealed this

Seventeenth Day of August, 2004

JON W. DUDAS
*Acting Director of the United States Patent and Trademark Office*